United States Patent [19]

Rosenberg et al.

[11] 4,215,160

[45] Jul. 29, 1980

[54] METHOD OF FORMING WATERPROOFING MATERIAL

[75] Inventors: Arnold M. Rosenberg, Potomac; James M. Gaidis, Ellicott City, both of Md.

[73] Assignee: W. R. Grace & Co., New York, N.Y.

[21] Appl. No.: 5,241

[22] Filed: Jan. 22, 1979

Related U.S. Application Data

[63] Continuation of Ser. No. 851,065, Nov. 14, 1977, abandoned.

[51] Int. Cl.[2] ..... B05D 3/04; B05D 3/12

[52] U.S. Cl. ..... 427/177; 118/69; 427/322; 427/398.2; 427/398.3; 427/398.5

[58] Field of Search ..... 427/398 A, 398 B, 177, 427/398 C, 398 D, 322; 156/247, 244.23; 118/69

[56] References Cited

U.S. PATENT DOCUMENTS

| | | | |
|---|---|---|---|
| 2,330,202 | 9/1943 | Brennan | 427/398 B X |
| 2,347,643 | 5/1944 | Schieman | 427/177 |
| 3,741,856 | 6/1973 | Hurst | 428/246 |

FOREIGN PATENT DOCUMENTS

| | | | |
|---|---|---|---|
| 951867 | of 1964 | United Kingdom | 427/398 A |

*Primary Examiner*—Evan K. Lawrence

*Attorney, Agent, or Firm*—Howard J. Troffkin; William W. McDowell, Jr.

[57] ABSTRACT

A method of preparing a preformed sheet-like waterproofing material in the form of a laminate structure of a sheet-like flexible support member having on one side thereof a flexible membrane of an adhesive bituminous composition. The method requires placing the flexible sheet-like polymeric support member in facing relationship with a forming surface, applying a coating of an adhesive bituminous composition having a temperature above the melting point of the polymeric support member to the opposite surface of the support and simultaneously cooling the forming surface at a rate at least sufficient to maintain the support member thereon below its melting point for a time at least sufficient to permit the bituminous composition to cool below the melting point of the support member. The present method alleviates the utilization of a non-structural release sheet during formation or packaging of the waterproofing composite structure.

9 Claims, 1 Drawing Figure

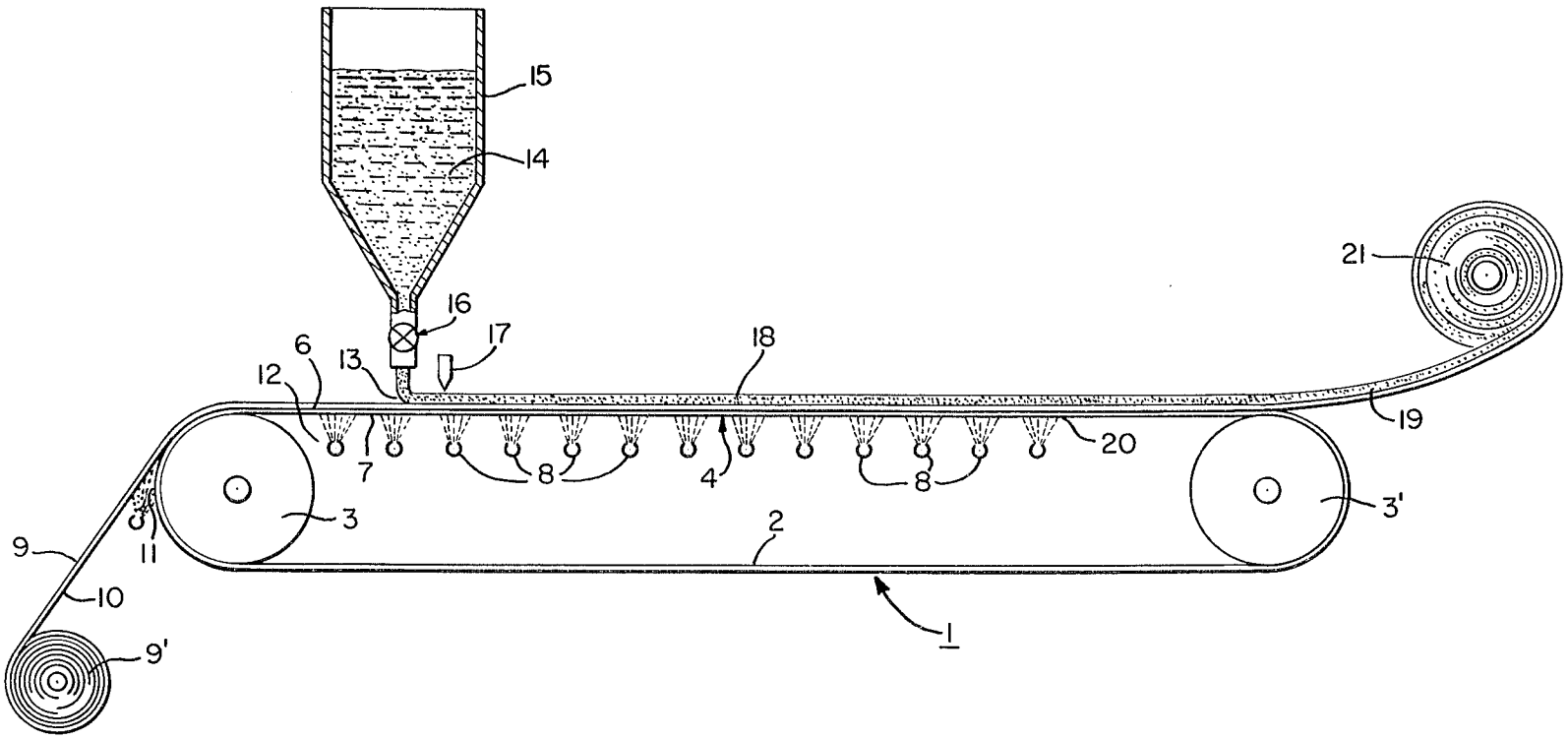
21
19
3'
20
8
1
18
2
4
8
15
14
17
16
13
7
6
12
3
11
10
9'
9

METHOD OF FORMING WATERPROOFING MATERIAL

This is a continuation, of application Ser. No. 851,065, filed Nov. 14, 1977, abandoned.

BACKGROUND OF THE INVENTION

The subject invention is directed to a novel method of forming a waterproofing material without the required need of a release sheet during or subsequent to its manufacture.

It is known that concrete surfaces and the like can be sealed in a waterproof manner by forming or applying thereon a membrane of a bituminous composition, such as asphalt, tar or pitch, which is substantially impermeable to moisture and water vapor. Preformed sheet-like materials useful for this purpose are well known. Examples of these materials are disclosed in U.S. Pat. Nos. 3,741,856, 3,853,682 and 3,900,102. These waterproofing materials have a laminate structure of a support sheet adjacent to a membrane of a bituminous composition which has adhesive properties which renders it adherent to the support material and to the substructure, such as a concrete slab, to which it is applied. Laminate structures presently commercially available are supplied in the form of rolls which further comprise a flexible release sheet adjacent to the exposed surface of the bituminous membrane. This release sheet is a required component in the present mode of manufacture and serves, in the end product, to prevent the adhesive membrane from adhering to the sheet immediately adjacent thereto when in roll form. The release sheet does not form a part of the finally applied sheet-like structure which renders a substructure waterproof and, therefore, creates problems of removal and disposal at the job site.

Preformed flexible, sheet-like waterproofing material requires the utilization of a release sheet, such as in the form of a siliconized paper, as an integral component in the presently known methods of formation. A release sheet capable of withstanding high temperatures is used as a forming surface upon which a hot semi-fluid bituminous composition, generally having a temperature of about 250° C. or greater, is applied. The composition must be cooled prior to superimposing a polymeric support on its free surface in order to minimize deteriation of the support. The resultant laminate structure, including the release sheet, is then formed into rolls for shipment. Alternately, when support sheets having a non-adherent free surface are used, the formed support-/membrane laminate is formed into rolls for storage and shipment by removing the laminate from the release sheet at the end of the manufacturing process.

SUMMARY OF THE INVENTION

The present invention provides a novel method of preparing a preformed sheet-like waterproofing laminate structure of a flexible sheet-like membrane and an adhesive Bituminous composition.

The method comprises applying a flexible polymeric support, one major side of which is non-adherent with respect to bituminous compositions, to a pre-wetted forming surface. The support is applied with its non-adherent major side in face-to-face relationship with the forming surface. A hot bituminous composition having a temperature above the melting point of the polymeric support member is applied to the other major side of the polymeric support while simultaneously cooling the forming surface at a rate sufficient to maintain the support thereon at a temperature below its melting point and continuously cooling for a time sufficient to cause the bituminous composition to cool below the melting point of the support. The present method does not require the utilization of a heat resistant release sheet during the formation or packaging of the laminate structure.

BRIEF DESCRIPTION OF THE DRAWING

Referring to the FIGURE, a preferred embodiment of the subject process is performed with the aid of an apparatus 1 comprising a continuous stainless steel belt 2 which is moving at a suitable rate with the aid of rollers 3 and 3'. The upper portion of continuous belt 2 forms a forming member 4. The upper surface of the forming member 4 acts as a forming surface 6 upon which the desired laminate structure is formed. Positioned below the lower, non-forming surface 7 of the forming member 4 is a bank of water jets 8 capable of impinging water onto the surface 7 of forming member 4.

A polymeric support member 9 in the form of flexible sheet-like polymer is fed from a supply roll 9' in a manner that the member's non-adherent surface 10 (by pretreatment) will be in facing relationship with the forming surface 6. The forming surface 6 of continuous belt 2 is sprayed with a small quantity of water at a point 11 prior to the application of the support member of the forming surface 6 to form a liquid film between the support member 9 and the forming surface 6. The bank of water jets 8 located below the forming member 4 start at a point 12 which is prior to the application point 13 of the bituminous composition onto the polymeric support member 9, thus causing precooling of the forming member 4 and the polymeric support member 9.

The bituminous composition 14 is maintained in storage vessel 15 at a suitable elevated temperature to permit it to readily flow and be applied at point 13 to the free side of the support member 9 positioned on forming surface 6 to form a continuous membrane 18 thereon. The thickness of the bituminous membrane is controlled by conventional techniques of metering by valve 16 which adjusts the rate of flow of the bituminous composition 14 from vessel 15 and further controlled by knife blade 17. The bank of water jets 8 maintains a continuous source of coolant on the forming member 4 which carries the formed bituminous adhesive membrane/-polymeric sheet laminate 19 at least to a point 20 where the bituminous composition 13 of the laminate is below the melting point of the polymer support member. The cooled laminate product 19 is taken up in the form of a roll with the release coated surface 10 of support member 9 adjacent to the free surface of the bituminous adhesive composition 14.

DETAILED DESCRIPTION OF THE INVENTION

The present invention is directed to a novel method of forming a flexible sheet-like laminate structure useful for waterproofing of substructures such as concrete substructures of buildings, roads, bridges and the like.

The flexible sheet-like structure is in the form of a laminate of a support sheet having superimposed on one major surface thereof a membrane of an adhesive bituminous composition. The opposite major surface of the support sheet is treated to be non-adherent to the bituminous membrane.

The present method permits the utilization of a wide variety of sheet-like polymeric supports to form waterproofing laminate structures. Generally the support should be substantially impermeable to water and, based on the laminate structure's end use, capable of stretching with movement of the concrete or other material of the substrate to which it is ultimately applied. To this end it is desirable that the laminate structure of the support and the membrane have, at 20° C., an elongation at break of at least 300 percent, a tensile strength of at least 1.5 kg per cm and an Elmendorf tear strength of at least 750 gm. However, where stretchability and flexibility are less important than other properties, supports not fulfilling these requirements can be utilized.

The polymeric supports can be formed of natural rubber or of a synthetic organic polymer such as polyethylene, polypropylene or other polyolefin, a polyamide, a polyester, e.g., polyethylene terephthalate, a polyurethane, a polyvinyl halide, such as a polyvinyl chloride and copolymers thereof, such as a copolymer of vinyl chloride and vinylidene chloride, a synthetic rubber, such as polychloroprene or butyl rubber, regenerated cellulose, cellulose, cellulose ethers or cellulose esters.

The supports can be films in the form of solid sheets, cellular films or woven and non-woven fabrics which are sufficiently non-porous to restrict the flow of the hot bituminous composition therethrough when applied.

The method of the present invention permits the use of supports having a wide range of melting temperatures. The supports may have a melting temperature as low as from at least about 80° C. with a melting temperature of from at least about 100° C. being preferred.

The support material is treated with a release coating on one major surface thereof. The release coating should be capable of making the surface substantially non-adherent to the bituminous material being used. The coating can be formed in any known manner at any time prior to application of the support to a forming surface as described hereinbelow. For example, the release coating can be formed on one of the major surfaces of the support by the deposition of a conventional silicon composition which is cured by the aid of a catalyst and/or heat. The support can then be formed into rolls for storage and delivery to the site of formation of the waterproofing laminate structure. Alternately, the release coating can be formed on the support material as an initial step in the present method of formation of the laminate structure. The support sheet can have any additional conventional features incorporated into its structure.

The resultant product does not have the conventional laminate structure of support sheet/membrane/release sheet which has less pliable outer members. Such structures, upon formation into storage rolls, causes distortion of the membrane and results in a defective waterproofing product.

The bituminous compositions can be any tar, asphalt, pitch or the like which is adhesive to and will render waterproof the contemplated substructure on which the final laminate product is to be used without the aid of heat or additional bonding agents at the site of application.

Thus, for application to surfaces of concrete, which are comparatively rough and dusty, the layer of adhesive composition must be at least about 0.025 to 0.2 inch (0.063 to 0.5 cm), the thicker the layer of adhesive-composition the better the waterproofing effect, but in general a layer of about 0.05 to 0.10 inch (0.12 to 0.25 cm) which is suitable.

Bituminous adhesive compositions are generally formed of natural or synthetic rubber, virgin or reclaimed, blended into bitumen to provide a smooth mix. The ratio by weight of bitumen to rubber is usually greater than about 75:25 with ratios of from about 80:20 to 95:5 being preferred. The compositions should be a non-solvent type which, preferably, is semi-fluid at temperatures of from about 125° C. and capable of application onto the support sheet as a coating. The resultant product is a flexible, pressure sensitive membrane having cold flow properties.

The present method utilizes a forming member which aids in supporting the polymeric support film and in withdrawing heat during the application of the bituminous composition. The forming member can be made of any suitable material which is durable to repeated use in the presently disclosed process, is substantially inert to corrosive action, has good thermal conductivity, and is capable of presenting a substantially smooth forming surface upon which the water-proofing product is formed.

The forming member can be in the form of a flat plate for discontinuous operation or, preferably, a continuous belt or cylinder for continuous or semi-continuous formation of the waterproofing laminate structure. The method will be described hereinbelow with respect to a continuous formation of the waterproofing laminate structure. Other modes of formation will be apparent to those skilled in this art.

The forming element should be made of a durable material which is inert to corrosion by the cooling liquid used in the present method. For example, the forming element can be a continuous belt in the form of a sheet of an inert material, such as stainless steel, brass or a non-inert material made inert by an inert coating formed from tetrafluoroethylene, epoxides, stainless steel, monel and the like. A continuous belt of stainless steel is preferred due to its durability, inertness and good thermal conductivity properties. A continuous forming member should present a forming surface which has a rate of movement of from about 5 to 90 feet per minute, with from about 25 to 60 feet per minute being preferred. Such rates are suitable to permit application of the adhesive composition in desired amounts to produce a membrane of desired thickness and also suitable to permit the cooling by the cooling means positioned in facing relationship with the non-forming surface of the forming member. The exact rate can be determined in conventional manners.

The present method requires the utilization of a polymeric support member which has one of its major surfaces treated to be non-adherent to the bituminous composition used and to be non-soluble with respect to the cooling liquid used in the preferred method of the present invention, as described hereinbelow. As described above, this treatment can be done prior to its utilization in the present method or as an initial step therein. In either instance, the release material should be coated on substantially one entire surface of the support member and permitted to cure thereon prior to placing the support member on the forming surface.

The flexible sheet-like polymeric member is placed on the forming surface of the forming element. For example, a suitable polymeric film is unwound onto a continuous moving belt made of stainless steel. The polymeric support member is oriented so that its non-adherent surface is in facing relationship with the forming surface.

It is preferred that a liquid be applied to the forming surface prior to placing the support member thereon. The application can be by spraying or by any other suitable means. The liquid can be any liquid which is inert with respect to the polymeric film, is a non-solvent with respect to the cured release composition and is substantially non-corrosive to the forming surface. Water is the preferred liquid. It has been unexpectedly found that the presence of a film of liquid between the polymeric support member and the forming surface greatly enhances the capability of maintaining the polymeric support film below its melting temperature during the application of the bituminous composition.

A coating of an adhesive bituminuous composition, as described hereinabove, is applied to the free side of the support film contained on the forming surface. The coating is applied in any conventional manner utilizing a hot composition having a temperature above the melting point of the polymeric support member which readily flows to form a continuous membrane. The thickness of the membrane can be controlled by conventional techniques. Sufficient amounts of the bituminous composition can be applied at one time to form the membrane of desired thickness or can be applied in increments. Incremental application can be done to further control the heat transfer and/or to permit the application of bituminous compositions of differing formulations.

Simultaneously with the application of the bituminous composition, the forming surface of the forming member is cooled at a rate sufficient to maintain the polymeric support member thereon at below its melting point. It has been found that this can be readily accomplished by contacting the non-forming surface of the formimg element with a cooling means such as chilled rollers or by impinging jets of a cooling liquid, preferably water, onto the non-forming surface of the forming member. The rate and temperature of the cooling means necessary to maintain the polymeric film at the desired temperature can be readily determined and will be related to the temperature and mode of application of the bituminous composition. It is desirable that the forming member, such as a continuous stainless steel belt, be relatively thin to permit more efficient cooling of the forming surface by such cooling means. In addition, the laminate structure can be supplementally cooled by a current of a cold or refrigerated gas, such as air, to maintain the polymeric support sheet below its melting point. Further, cooling may be initiated prior to the application of the bituminous composition and continued simultaneously therewith.

The cooling should be continuously maintained at least until the bituminous composition of the laminate structure is at least below the melting point of the polymeric support member.

The formed sheet-like waterproofing laminate structure is removed from the forming surface and taken up as a roll with the non-adherent side of the support film in facing relationship with the free surface of the bituminous composition. Rolls of desired lengths of material are cut away from the remainder of the laminate structure to yield a free surface of the continuous belt, ready for additional formation of laminate structure.

The following example is given for illustrative purposes only and is not meant to limit the invention except as set forth by the claims hereinbelow. All parts and percentages are by weight except where otherwise indicated.

EXAMPLE

A continuous belt is formed from a flexible sheet of stainless steel which is capable of rotation around two end rollers which cause the movement of the belt. The belt has substantially an upper forming portion and a lower return portion with the necessary guide and support rollers associated therewith. Further, the belt is equipped with a mist sprayer positioned at the beginning and directed toward the top surface of the forming portion of the belt, a bank of sprayers positioned along the underside portion of forming portion of the belt and splash guards positioned along the length and at the edges of the forming portion of the stainless steel belt.

The belt, moving at a rate of about 30 to 90 feet per minute is sprayed with a mist of water on its forming surface at a position prior to the application of the support sheet. A 4 mil thick polyethylene support sheet (melting temperature of about 80° C.) having one surface coated with a release agent of a poly(dimethylsiloxane) base is fed from a supply roller and applied to the prewetted forming surface. The surfce of the support sheet which is coated with release agent is placed in face-to-face relationship wth the forming surface.

A hot (130° C.) adhesive bituminous composition compound composed of 75 parts by weight bitumen and 25 parts by weight reclaimed rubber is applied (as a 60 mils thick coating, with the aid of a blade over the applied composition) to the free non-treated surface of the support sheet on the stainless steel belt, while simultaneously subjecting the undersurface of the forming portion of the belt to a continuous stream of cold (5° C.) water. The cooling of the belt and the support sheet thereon is continued for approximately 30 feet of belt length, at which point the bituminous composition has cooled below the melting point of the polyethylene. The structure is also allowed to air cool on the forming surface until it attains a temperature of about 45° C. The formed structure is removed from the stainless steel belt and taken up in the form of a roll with the release coated surface of the support sheet adjacent to the free surface of the formed bituminous adhesive membrane.

While the present invention has been described in connection with certain preferred embodiments, it is not intended to limit the invention to the particular form set forth, but, on the contrary, it is intended to cover such alternatives, modifications and equivalents as may be included within the spirit and scope of the invention as defined by the appended claims.

What is claimed is:

1. A method of forming a sheet-like, laminate waterproofing structure of a flexible sheet-like polymeric member having a first major side thereof substantially non-adherent to bituminous compositions and having a second major side thereof coated with a flexible membrane layer of adhesive bituminous composition comprising supplying a forming member having a forming and a non-forming surface;

placing a flexible sheet-like polymeric member on the forming surface of the forming member with its first major side facing the forming surface, said first major side being substantially non-adherent to the bituminous compositions;

applying a semi-fluid adhesive bituminous composition having a temperature above the melting point of the polymeric member to a second major side of the polymeric member in an amount sufficient to form a membrane thereof of said composition of from about 0.025 to 0.2 inch thick while simultaneously cooling the forming surface at a rate sufficient to maintain the polymeric member below its melting point and having said forming surface support said polymeric member during application of the bituminous composition and the cooling; and continuously cooling the forming surface at least until the bituminous composition of said structure has a temperature below the melting point of the polymeric member.

2. A method of forming a sheet-like laminate waterproofing structure of a sheet-like polymeric member having a first major side thereof substantially non-adherent to bituminous compositions and having a second major side thereof coated with a flexible membrane layer of adhesive bituminous composition comprising supplying a forming member having a forming and a non-forming surface;

placing a flexible sheet-like polymeric member on the forming surface of the forming member with its first major side facing the forming surface; said first major side being substantially non-adherent to the bituminous compositions;

cooling the forming surface of said forming member and the flexible sheet-like polymeric member placed thereon;

thereafter applying a semi-fluid adhesive bituminous composition having a temperature above the melting point of the polymeric member to a second major side of the polymeric member in an amount sufficient to form a membrane of said composition of from about 0.025 to 0.2 inch thick, while simultaneously and continuously cooling the forming surface at a rate sufficient to maintain the polymeric member below its melting point and having said forming surface support said polymeric member during application of the bituminous composition and the cooling; and continuously cooling at least until the bituminous composition of said structure has a temperature below the melting point of the polymeric member.

3. The method of claim 1 or 2 further comprising applying an aqueous liquid to the forming surface prior to placing the sheet-like polymeric member thereon.

4. The method of claim 3 wherein the forming member is formed from a thermoconductive material and continuously moves in the direction in which said laminate is formed.

5. The method of claim 4 wherein the cooling is at least partially accomplished by applying a cooling liquid to the non-forming surface of the forming member.

6. The method of claim 4 wherein the cooling is at least partially accomplished by applying a cooling liquid to the non-forming surface of the forming member and at least partially by cooling the laminate structure with a current of cold gas.

7. The method of claim 4 wherein the forming surface is substantially smooth and the polymeric member is substantially smoothly applied to the contour of the forming surface.

8. The method of claim 4 further comprisng removing the cooled sheet-like waterproofing structure from the forming surface and forming the structure into a roll of alternating polymeric member /membrane laminate.

9. The method of claim 4 further comprising applying and curing a release composition to the first major side of the polymeric support sheet prior to application of said sheet on said forming surface.

* * * * *